US006035678A

United States Patent [19]

Fletcher

[11] Patent Number: 6,035,678

[45] Date of Patent: Mar. 14, 2000

[54] DOOR-LOCK ASSEMBLY

[76] Inventor: Joseph Albert Francis Fletcher, 444 Lickey Road, Rednal, Birmingham, United Kingdom, B45 8UU

[21] Appl. No.: 09/233,987

[22] Filed: Jan. 19, 1999

[51] Int. Cl.[7] ..... E05B 9/08

[52] U.S. Cl. ..... 70/337; 70/370; 70/451; 70/461; 70/462; 70/466; 70/DIG. 41; 70/DIG. 63

[58] Field of Search ..... 70/337, 339, 370–372, 70/431, 423, 451, 455, 461, 462, 466, DIG. 41, DIG. 63

[56] References Cited

U.S. PATENT DOCUMENTS

| | | | |
|---|---|---|---|
| 1,323,753 | 12/1919 | Gogay | 70/451 |
| 1,647,567 | 11/1927 | Hemingway, Jr. | 70/372 |
| 2,696,726 | 12/1954 | Segal | 70/370 |
| 4,350,032 | 9/1982 | Kochackis | 70/DIG. 63 X |

FOREIGN PATENT DOCUMENTS

| | | | |
|---|---|---|---|
| 431717 | 6/1991 | European Pat. Off. | 70/451 |
| 2442943 | 8/1980 | France | 70/451 |
| 63936 | 5/1980 | Japan | 70/DIG. 63 |

*Primary Examiner*—Lloyd A. Gall
*Attorney, Agent, or Firm*—Renner, Kenner, Greive, Bobak, Taylor & Weber

[57] ABSTRACT

A security device for obscuring an opening defined by a frame (100) is provided comprising a door panel portion (1) forming at least a part of a door which, in use, is supported relative to the frame. The door panel portion has a front face and a rear face and an aperture provided therein, a lock retaining member (2) having a first lock receiving aperture (6) provided therein and a second lock receiving aperture (7) provided therein. Each lock receiving aperture is adapted to receive a lock and the lock retaining member is adapted to be secured to the rear face of the door panel portion in at least a first and a second position and in which first position the first and second lock receiving apertures are visible through the aperture in the door panel portion, and in the second position only one of the lock receiving apertures is visible through the aperture.

18 Claims, 5 Drawing Sheets

DOOR-LOCK ASSEMBLY

BACKGROUND OF THE INVENTION

This invention relates to improvements in security for doors, for use in security enclosures, such as safes in general and in particular, although not exclusively, to a security chamber, such as the safe or coin box in coin-operated apparatus.

There are many types of coin-operated apparatus for both public and private use, such as gambling machines or video game machines, in which the apparatus will only operate when the correct coinage is inserted. During prolonged use, a number of coins are retained in a coin box within the apparatus until the coins are emptied by the operator or owner. As such, these machines offer a target for petty theft.

To prevent unauthorised access to the coin box, a simple hinged door within a rigid frame is typically provided. The door is locked in place by a barrel lock mounted through a suitable hole in the door. Operation of the lock by a key causes a finger attached to the barrel of the lock to rotate to engage behind a keeper secured to the frame.

The use of a simple barrel lock mounted to the door as described above has proved unsatisfactory in that it can be easily prised open by inserting a lever between the door and the frame, bending the door to deform the finger. To prevent such an attack, many operators provide additional security by providing a locking bar which is hingebly attached to the apparatus at one end and can be locked using a padlock to the apparatus at the other end. In the locked position, the bar covers the door opening. To open the door, the locking bar must therefore be moved from across the door opening.

As well as providing increased security, the locking bar provides the facility for a dual lock security arrangement. By providing separate, usually different, keys for the padlock on the locking bar and the door barrel lock, and giving each key to a separate person, the door cannot be opened unless both people are present. This can reduce instances of unauthorised access. A major problem with the locking bar arrangement, however, is that it is unsightly, and the inventor believes the presence of such conspicuous security actually increases the likelihood of theft or vandalism by presenting the wrong impression to customers.

An object of the present invention is to provide an improved security arrangement for securing a door in an opening of a security enclosure, in particular a door for a coin fed apparatus.

In accordance with a first aspect of the invention, a security device for obscuring an opening defined by a frame is provided comprising a door panel portion forming at least a part of a door which, in use, is supported relative to the frame, the door panel portion having a front face and a rear face and an aperture provided therein, a lock retaining member having a first lock receiving aperture provided therein and a second lock receiving aperture provided therein, each lock receiving aperture being adapted to receive a lock and in which the lock retaining member is adapted to be secured to the rear face of the door panel portion in at least a first and a second position and in which said first position the first and second lock receiving apertures are visible through the aperture in the door panel portion, and in the second position only one of the lock receiving apertures is visible through the aperture.

An advantage of the invention is that the arrangement of the lock retaining member in either the first or second position allows the choice of either two lock mounting points (i.e. two lock receiving apertures) for two locks or a single lock mounting point for a single lock without need to produce a separate door panel portion or lock retaining member for each case.

In the first position, both lock receiving apertures may be arranged substantially symmetrically within the aperture in the door panel portion. In the second position, the one visible lock receiving aperture may be disposed substantially at the centre of the aperture in the door panel portion.

The door panel portion and lock retaining member may be pressed from flat metal sheet such as steel sheeting. Alternatively, the door panel portion and lock retaining member may be laser cut from steel sheet. The door panel portion and frame may be laser cut from a single steel sheet so the door is a good fit within the frame with only a small clearance all round. Laser cutting enables alternations to the profile of the door panel portion and the frame etc without the need for expensive alteration of tooling.

The door panel portion may be provided with one or more mounting portions, and the lock retaining member may be provided with one or more mounting points. The lock retaining member may thus be secured to the door panel portion by engagement of the mounting portions with one or more of the mounting points. All the mounting portions may engage the lock retaining member in the first position, and engage different points in the second position. Each mounting portion may comprise a bolt.

The lock receiving apertures may each comprise a hole having a substantially circular outline and a pair of opposing flat surfaces for receiving a barrel lock having a complementary profile. This prevents rotation of the barrel within the apertures. Of course, any other aperture shape for accommodating a lock may be employed.

Preferably, the mounting portions also act as securing means for securing a bolt assembly to the door panel portion. The mounting portions may be the only securing means for the bolt assembly. The bolt assembly is adapted to be operated either directly or indirectly by the rotating action of the lock(s) to engage with a keeper provided on a frame to which the door is mounted. The strength of the security apparatus is thus greatly increased over an assembly in which a finger on the lock engages the keeper.

In one arrangement, the lock comprises a barrel which rotates under the action of a key to rotate a cam or finger which extends radially away from the end of the barrel opposite to the end in which the key is inserted. The finger may be adapted to displace a portion of the bolt assembly in a plane substantially parallel to the plane of the door panel to a position in which a portion of the bolt is behind the frame or to a position in which it engages with a keeper mounted on the frame. Of course, the skilled man would appreciate that a keeper is not essential to the invention.

The sliding portion of the bolt assembly may be spring loaded towards either the open position in which it does not slide behind the frame or engage the keeper or spring loaded to the closed position in which it engages the keeper. In the first case, the action of the lock causes the finger to act upon the sliding portion against the spring force to open the door, the opposite occurring in the later case. Thus, in the first case, removal of the lock (e.g. by pushing it out of the lock retaining aperture) would cause the door to remain secure as the bolt would still engage the keeper.

Preferably, the door panel portion comprises substantially the whole of a door and is provided with means along one edge for attaching that edge of the door to a frame. A hinge or a plurality of hooks which engage behind eyes in the frame may be provided for this purpose. The engagement between the door and frame along that side should be such that the door cannot be prised out of the frame. Also, the bolt assembly may engage a keeper disposed on the opposite side of the door panel portion to the attaching means.

According to a second aspect of the invention, we provide a coin-operated apparatus which includes a door frame defining an opening and a security device comprising a door panel portion and a lock retaining member according to the first aspect of the invention.

The coin-operated apparatus may comprise a coin-fed gambling machine, or may comprise a pool table for example.

BRIEF DESCRIPTION OF THE DRAWINGS

There will now be described, by way of example only, one embodiment of the invention with reference to the accompanying drawings of which.

DESCRIPTION OF THE PREFERRED EMBODIMENT

Figure 1:
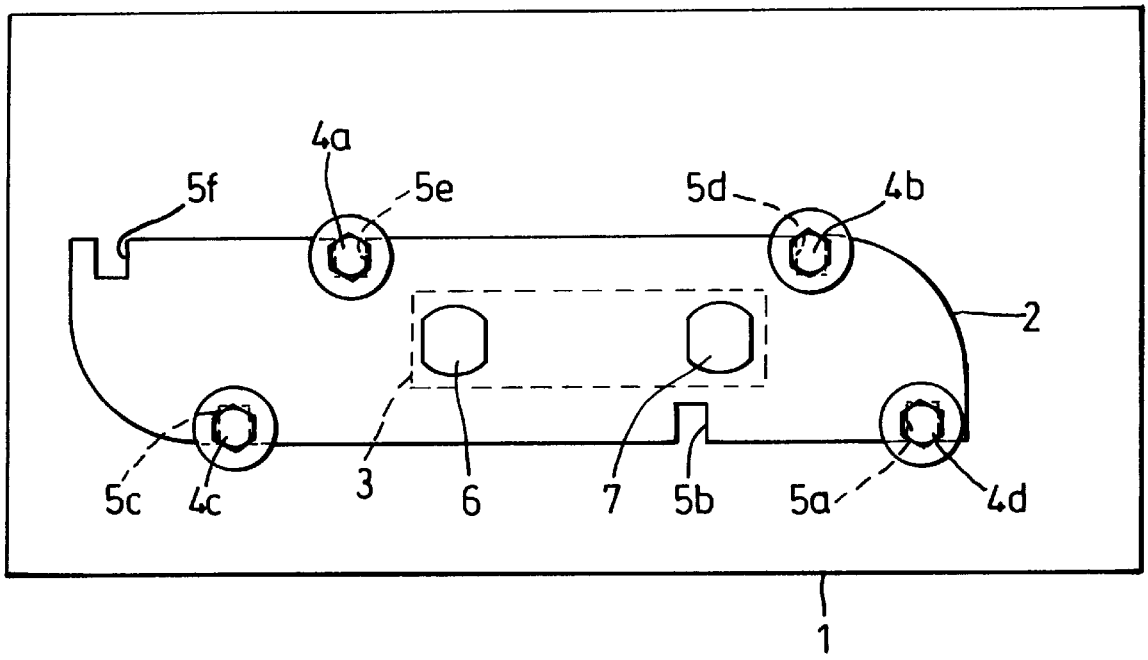
FIG. 1 is an overhead view of the rear face of the door panel portion of a first embodiment showing the location of the lock retaining member in a first position.

FIG. 1 shows the arrangement of a door panel 1 and a lock retaining member 2 of the first embodiment.

The door panel 1 is provided with an aperture in the form of an elongate rectangular slot 3. Four mounting portions in the form of coach bolts 4*a*, 4*b*, 4*c* and 4*d* are provided which extend through square cut-outs through the panel. They may be welded in place to prevent rotation, and are provided with a smooth rounded head so they cannot easily be rotated. The bolts extend through from a front face of the door panel with the threaded portion extending away from the rear face (i.e. out of the page in FIG. 1).

The retaining member 2 is in the form of a flat plate and is provided with six recesses 5*a*, 5*b*, 5*c*, 5*d*, 5*e* and 5*f* around its perimeter which can accommodate the shank of the mounting bolts 4*a*, 4*b*, 4*c* and 4*d*. These recesses define mounting points.

The retaining member also has a first and second lock receiving opening 6, 7 provided towards the centre of the member. Each opening is adapted to receive the barrel of a standard barrel lock as is known to the person skilled in the art.

Figure 2:
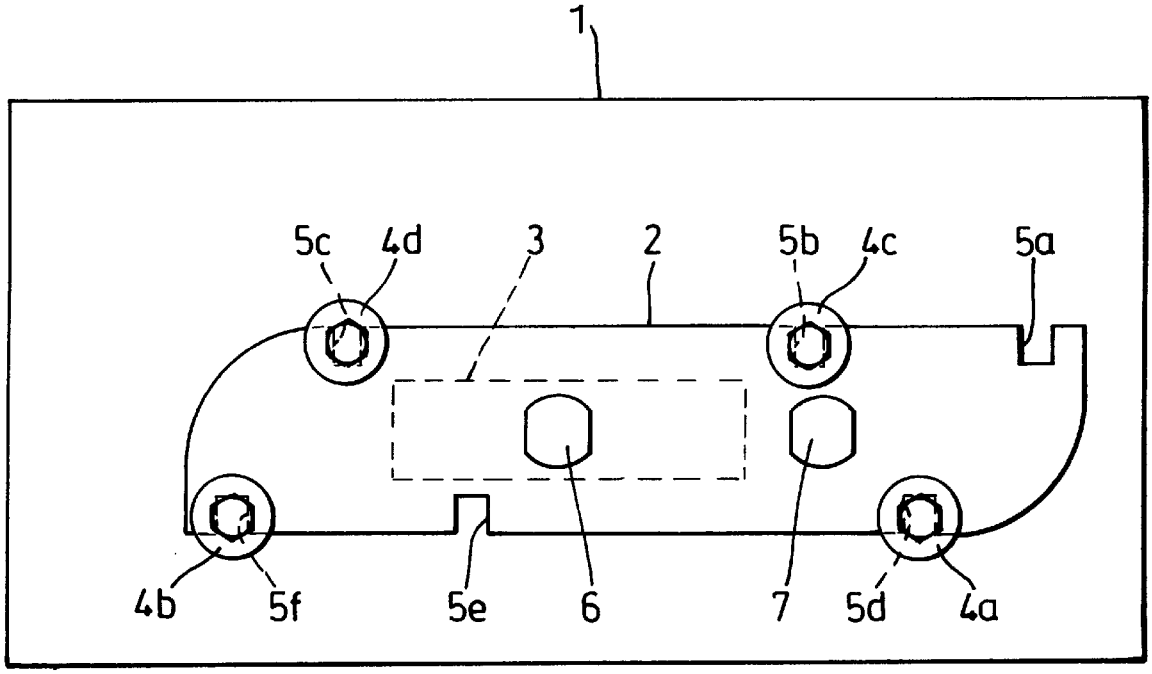
FIG. 2 is an overhead view similar to FIG. 1 in which the lock retaining member is secured in the second position.

The retaining member is secured to the door with the bolts 4*a*, 4*b*, 4*c*, 4*d* engaging four of the recesses 5*a*, 5*b*, 5*c*, 5*d*, 5*e* and 5*f* in either a first position as shown in FIG. 1 or in a second position as shown in FIG. 2. The two positions are interchangeable by loosening the bolts and moving the lock retaining member relative to the door panel.

As shown in FIG. 1, the retaining member is secured so as to completely obscure the aperture 3 from the rear of the door panel portion 1 with both lock receiving apertures 6, 7 visible from the front of the door panel through the aperture. Thus, two barrel locks can be installed.

As shown in FIG. 2, the retaining member is again secured so as to completely obscure the aperture 3 but with only a single lock receiving aperture 6 visible through the aperture 3. Thus, only one lock barrel can be installed. There is no unsightly hole where the second lock opening is located (as it is hidden and not visible through the aperture) and because the single opening 6 is central in the aperture, a professional finish is achieved. No blanking plates are needed for the unused opening.

Because the assembly can be switched from single lock to dual lock operation by simple re-arrangement of the components after loosening the bolts 4*a*–4*d*, the user can change the configuration at any time. Of course, it is envisaged that the member 2 may be welded or glued in place after initial assembly to prevent such rearrangement if desired. The advantages of reduced parts and lower cost would still be obtained, as only one design of lock retaining plate need to be held in stock.

Figure 3:
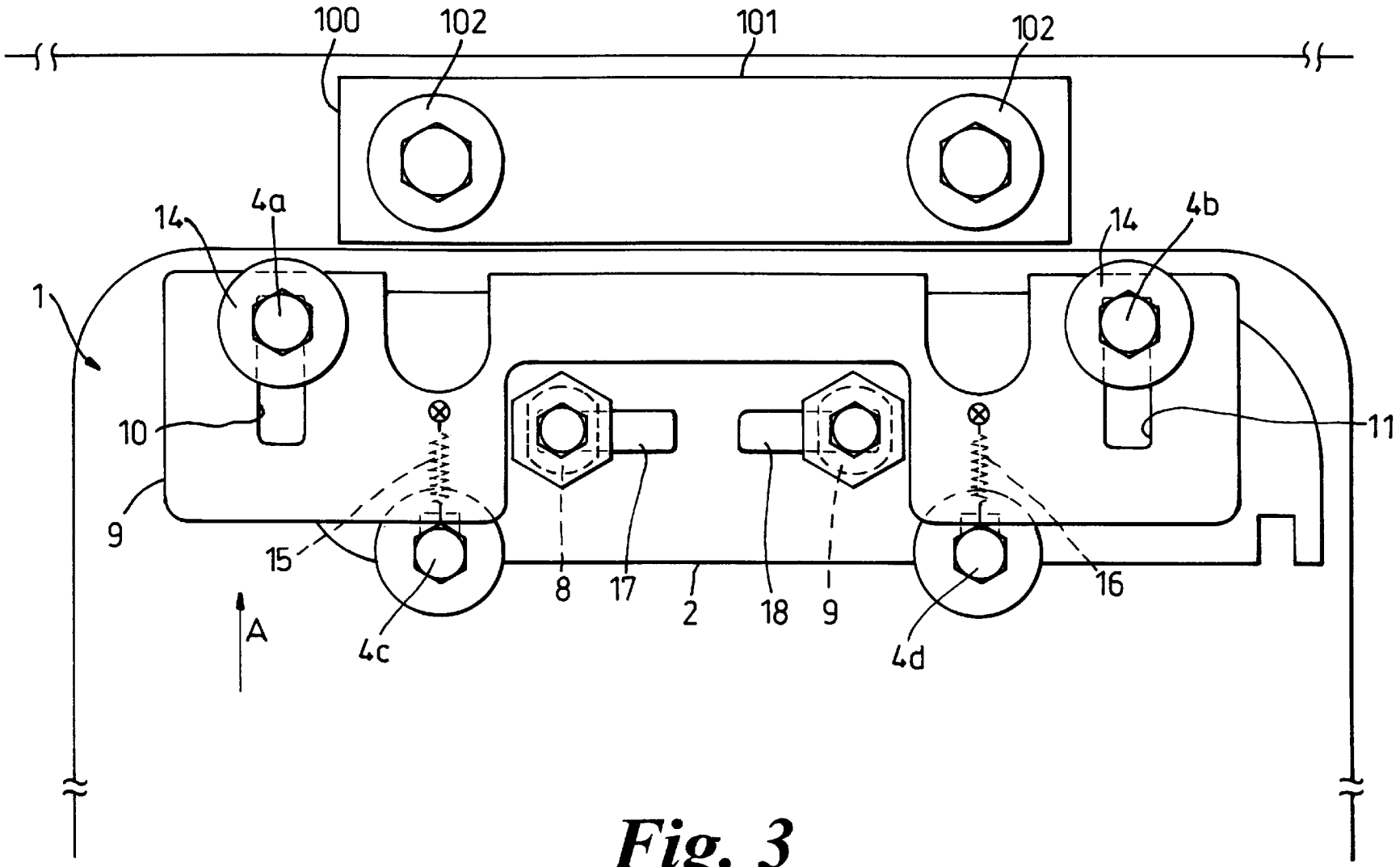
FIG. 3 is an overhead view similar to FIG. 1 showing the location of the lock barrels in the locking member and the bolt mechanism shown in the open (unlocked) position.
Figure 5:
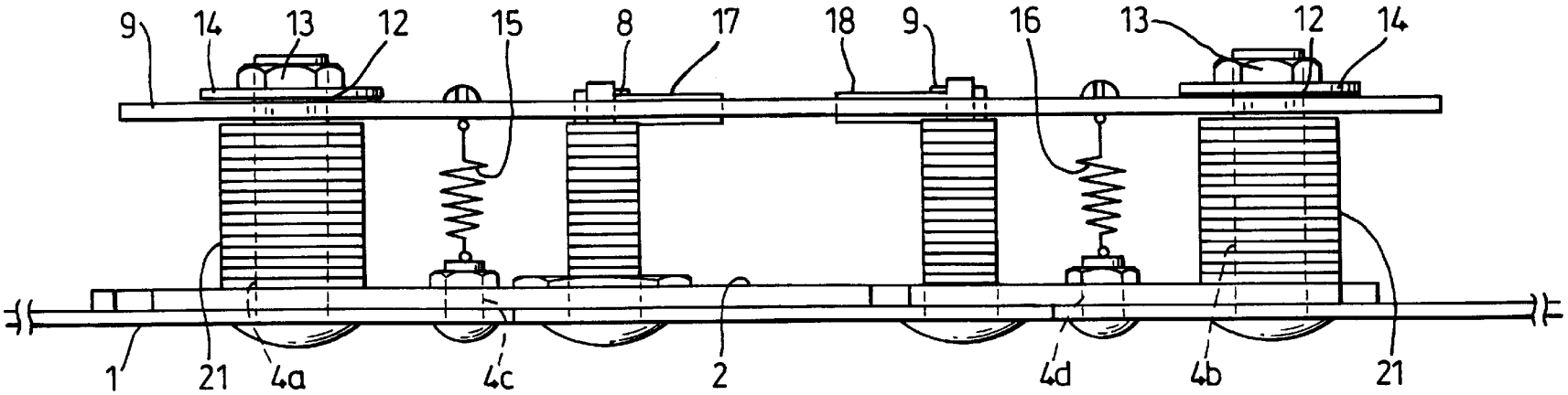
FIG. 5 is an end view of the assembly shown in FIG. 3 in the open (unlocked) position.

FIG. 3 shows a door panel and lock retaining plate together with two barrel locks 8, 9 and bolt mechanism which forms a complete door assembly for installation in a door frame 100. The bolt assembly and barrel locks are shown in the open (unlocked) position. Reference is also made to FIG. 5 which shows the assembly viewed end-on in the direction A.

The door panel is provided in a door frame 100. The door frame comprises a first frame portion and a second frame portion which sandwich either side of the panel of the apparatus into which the door is fitted. The frame has a keeper plate 101 supported away from its rear face by two coach bolts 102 which are each surrounded by a stack of washers to space the plate 101 from the frame 100. (The frame is not shown in FIG. 5). Of course, if the door panel and frame are such that the door panel is prevented from being pushed inwards through the aperture, no keeper plate 101 need be provided.

The bolt assembly comprises a plate 9 which is provided with two slots 10, 11 to facilitate sliding of the plate 9 relative to the two mounting bolts 4*a*, 4*b*. The plate 9 is spaced from the door panel by a number of spacers 21 (shown in FIG. 5), a bush 12 and a top nut 13 and washer 14. The plate is biased away from the edge of the door panel in its open position by springs 15, 16 which are each connected at one end to the plate using a small nut and bolt, and at the other end to one of the mounting nuts 4*c*, 4*d* respectively. Of course, the skilled man would appreciate that the springs need not engage the nuts 4*c*, 4*d* but could be connected at some other point.

A recess (shown above locks 8, 9 in FIG. 3) is provided in the edge of the plate furthest from the edge of the door panel which leaves space for accommodating the two lock barrels. Each barrel is provided with a finger 17, 18 which is spaced from the door panel by the length of the lock barrels. Rotation of a key in each lock causes the fingers to rotate to engage the plate 9. Hence, the spacers 21 should be chosen to suit the length of the lock barrels, or vice versa. It is also envisaged that the fingers 17, 18 could be deformed to accommodate varying lengths of lock barrel, and that sufficient free play may be provided between the plate 9 and its mounting bolts to allow it to be displaced at an angle.

Figure 4:
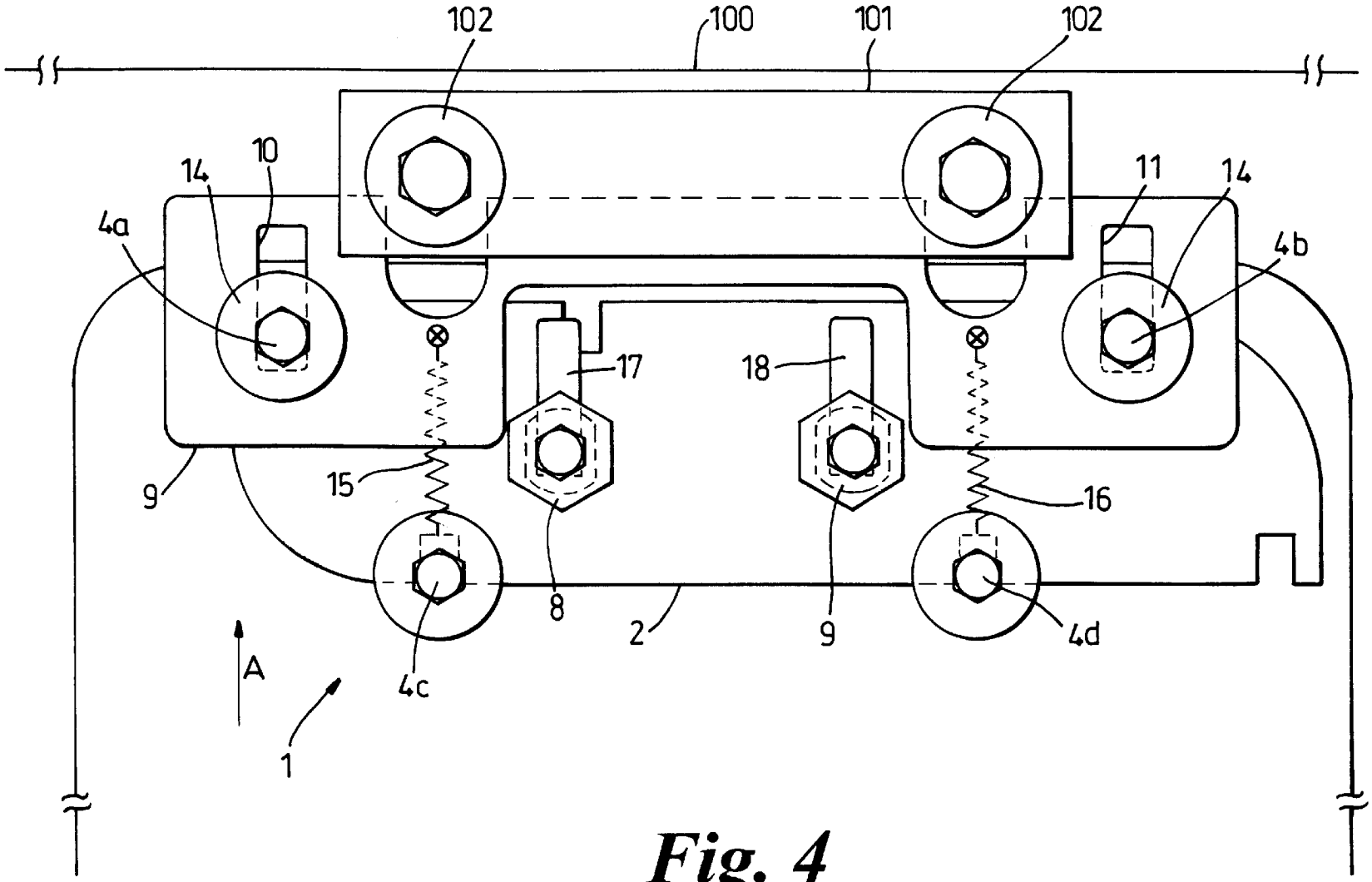
FIG. 4 corresponds to FIG. 3 but shows the bolt mechanism in the closed (locked) position with both lock barrels rotated.

FIG. 4 shows the identical view of FIG. 3 in which the locks have been rotated to the closed position and the fingers 17, 18 have pushed the plate 9 in between the frame 100 and the keeper plate 101. In this position, the door cannot be easily opened until the locks are returned to the open position and the springs 15, 16 draw the plate 9 back away from the keeper 101.

As can be seen from FIG. 3 and FIG. 4, the strength of the door security assembly is determined by the strength of the plate 9 and the keeper 101 and frame 100.

Figure 6:
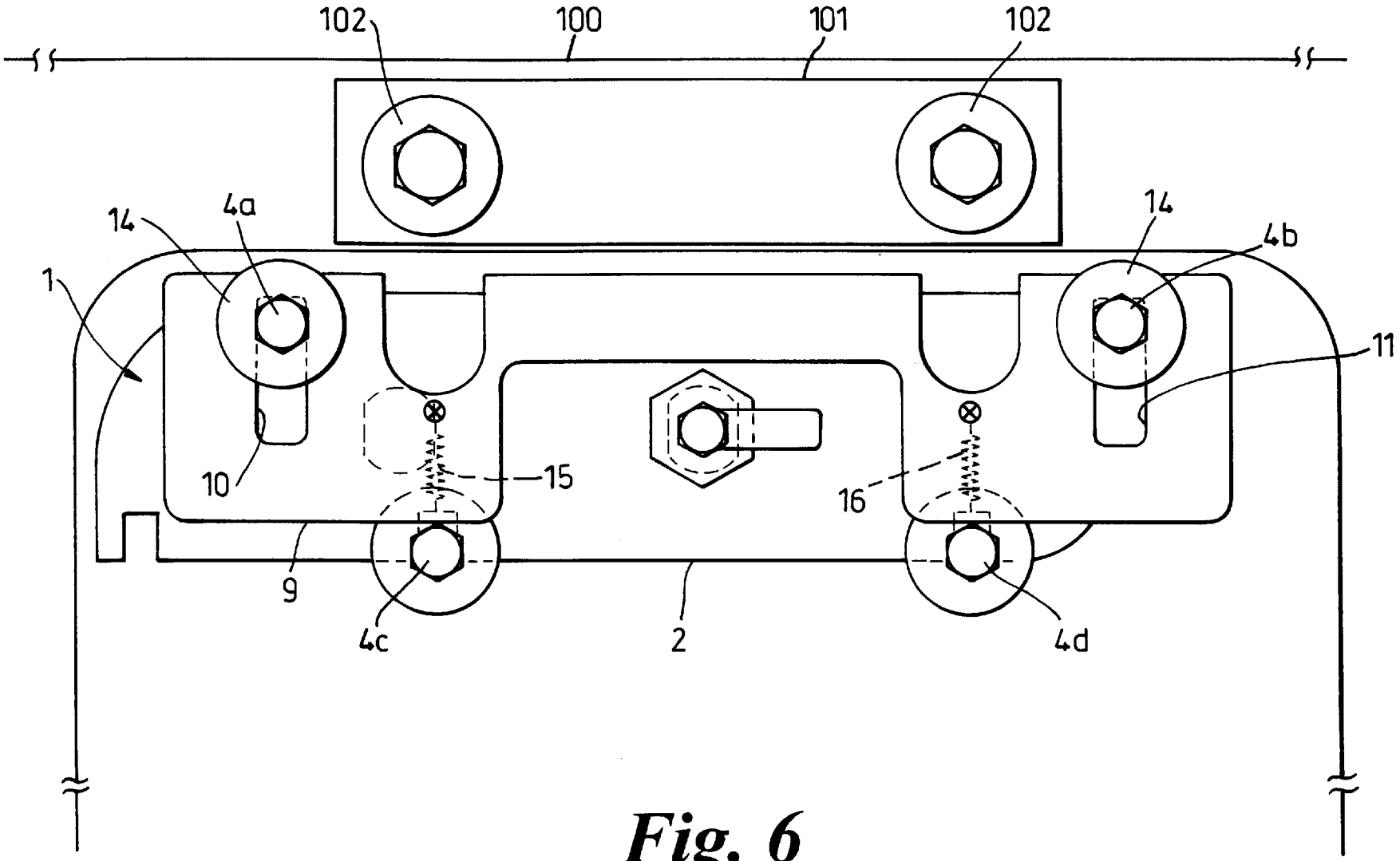
FIG. 6 shows an overhead view of the assembly of FIG. 3 but with the lock retaining member reversed for single lock use.

FIG. 6 shows an arrangement similar to FIG. 3 except that the lock retaining plate has been moved so that only a single lock operation is possible. The components used are identical to those shown in FIG. 3, and the operation is the same except only a single key is required.

Another feature apparent from FIGS. 3 to 5 is that the member 2 is shaped to be accommodated within the door panel 1 by radiusing some of the outer corners to match the radius of the corners of the door panel. Thus, the lock retaining panel can be made as large as possible within the available space. The sharing of the mounting bolts between the member 2 and the bolt mechanism also reduces parts to a minimum, again reducing cost and complexity.

Of course, it will be readily appreciated that whilst the present invention has been described in relation to coin-fed apparatus, it will also find application in many other areas such as low cost safe deposit boxes or storage lockers. Indeed, any case where a door is secured in a frame to prevent forced access is envisaged to fall within the scope of the present invention.

I claim:

1. A security device for obscuring an opening defined by a frame comprising a door panel portion forming at least a part of a door which, in use, is supported relative to said frame, said door panel portion having a front face and a rear face and an aperture provided therein, a lock retaining member having a first lock receiving aperture provided therein and a second lock receiving aperture provided therein, each said lock receiving aperture being adapted to receive a lock and in which said lock retaining member is adapted to be secured to said rear face of the door panel portion in at least a first and a second position and in which in said first position said first and said second lock receiving apertures are visible through said aperture in said door panel portion, and in the second position only one of the said lock receiving apertures is visible through said aperture.

2. A security device according to claim 1 wherein in the said first position, both said lock receiving apertures are arranged substantially symmetrically within said aperture in said door panel portion.

3. A security device according to claim 1 wherein in the said second position, the said one visible lock receiving aperture is disposed substantially at a center of said aperture in said door panel portion.

4. A security device according to claim 1, wherein said door panel portion and said lock retaining member are pressed from flat metal sheet.

5. A security device according to claim 1, wherein said door panel portion and said lock retaining member are laser cut from steel sheet.

6. A security device according to claim 5 wherein said door panel portion and said lock retaining member are laser cut from a single steel sheet.

7. A security device according to claim 1 wherein said door panel portion is provided with at least one mounting portion, and the lock retaining member is provided with at least one mounting point, said lock retaining member being secured to said door panel portion by engagement of said mounting portions with said mounting points.

8. A security device according to claim 7 wherein each mounting portion comprises a bolt.

9. A security device according to claim 7 said mounting portions act as securing means for securing a bolt assembly to the door panel portion, and said mounting portions are the only securing means for the bolt assembly.

10. A security device according to claim 9 wherein said bolt assembly is adapted to be operated by rotating action of said lock(s) to engage with a keeper provided on a frame to which said door is mounted.

11. A security device according to claim 1, wherein said lock receiving apertures each comprise a hole having a substantially circular outline and a pair of opposing flat surfaces for receiving a barrel lock having a complementary profile.

12. A security device according to claim 11 wherein said lock comprises a barrel which rotates under the action of a key to rotate a finger which extends radially away from the end of said barrel opposite to the end in which said key is inserted.

13. A security device according to claim 12 in which said finger is adapted to displace a portion of a bolt assembly in a plane substantially parallel to the plane of said door panel portion to a position in which a portion of said bolt assembly is behind said frame or to a position in which said bolt assembly engages with a keeper mounted on said frame.

14. A security device according to claim 13 wherein said portion of said bolt assembly is spring loaded.

15. A security device according to claim 1, wherein said door panel portion comprises substantially the whole of a door and is adapted to be provided with means along one edge for attaching that edge of the door to a frame.

16. A coin-operated apparatus comprising a door frame defining an opening and a security device for obscuring an opening defined by said frame comprising a door panel portion forming at least a part of a door which, in use, is supported relative to said frame, said door panel portion having a front face and a rear face and an aperture provided therein, a lock retaining member having a first lock receiving aperture provided therein and a second lock receiving aperture provided therein, each said lock receiving aperture being adapted to receive a lock and in which said lock retaining member is adapted to be secured to said rear face of the door panel portion in at least a first and a second position and in which in said first position said first and said second lock receiving apertures are visible through said aperture in said door panel portion, and in the second position only one of the said lock receiving apertures is visible through said aperture.

17. A coin-operated apparatus according to claim 16 which comprises a coin-fed gambling machine.

18. A coin-operated apparatus according to claim 16 which comprises a pool table.

* * * * *